US007465661B2

(12) United States Patent
Merritt et al.

(10) Patent No.: US 7,465,661 B2
(45) Date of Patent: Dec. 16, 2008

(54) HIGH ASPECT RATIO MICROELECTRODE ARRAYS

(75) Inventors: Charles Merritt, Fairfax, VA (US); Brian Justus, Springfield, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 124 days.

(21) Appl. No.: 10/446,257

(22) Filed: May 28, 2003

(65) Prior Publication Data

US 2004/0241965 A1 Dec. 2, 2004

(51) Int. Cl.
*H01L 21/326* (2006.01)
*H01L 21/479* (2006.01)

(52) U.S. Cl. ..... 438/667; 438/468

(58) Field of Classification Search ..... 438/20, 438/66, 73, 128, 468, 478, 667, 668; 607/1
See application file for complete search history.

(56) References Cited

U.S. PATENT DOCUMENTS 4,301,196 A * 11/1981 McCormack et al. ..... 427/99.1
4,647,476 A * 3/1987 Anthony ..... 438/665
5,159,231 A * 10/1992 Feller et al. ..... 313/103 CM
5,264,722 A * 11/1993 Tonucci et al. ..... 257/443
5,959,297 A * 9/1999 Weinberg et al. ..... 250/288
6,185,961 B1 2/2001 Tonucci et al.
6,262,357 B1 * 7/2001 Johnson et al. ..... 136/203
6,415,086 B1 * 7/2002 Hirsch ..... 385/116
6,753,196 B2 * 6/2004 Komoda et al. ..... 438/20
7,101,633 B2 * 9/2006 Yamaguchi et al. ..... 428/815.2
2002/0130046 A1 * 9/2002 Cheung et al. ..... 205/104
2003/0168340 A1 * 9/2003 Kaja et al. ..... 205/96
2004/0084319 A1 * 5/2004 Cohen ..... 205/118
2007/0114133 A1 * 5/2007 Ritzdorf et al. ..... 205/105

* cited by examiner

*Primary Examiner*—Zandra V. Smith
*Assistant Examiner*—Pamela E Perkins
(74) *Attorney, Agent, or Firm*—John J. Karasek; L. George Legg

(57) ABSTRACT

A method of electroplating a metal into a plurality of channels within an insulating material includes mounting the material to a cathode; placing the cathode into an electroplating solution containing the metal; placing an anode into the electroplating solution; connecting the cathode and the anode to a power supply; controlling operation of the power supply to provide a beginning current density during deposition at the insulating material and initiating electroplating of the metal within the plurality of channels starting at one face of the insulating material; and controlling operation of the power supply to provide a final current density during deposition at the insulating material and ending electroplating of the metal within the plurality of channels at the other face of the insulating material. The final current density is larger than the beginning current density, and the beginning current density is maintained at a level for a sufficient time to substantially prevent bubble formation during the electroplating.

9 Claims, 7 Drawing Sheets

HIGH ASPECT RATIO MICROELECTRODE ARRAYS

BACKGROUND OF THE INVENTION

1. Field of the Invention

The present invention relates to arrays of conducting microelectrodes and particularly to arrays that have metallic, high-aspect-ratio microelectrodes, high surface area, surfaces that can be ground and polished to nonplanar shapes, and compatibility with biological tissue.

2. Description of the Related Art

Microelectrode arrays are used to deliver or detect (stimulate or record) electrical signals at discrete, spatially resolved locations. Microelectrode arrays are desirable for use in a number of diverse applications, including, for example, stimulation and recording of neural signals in a neural prosthesis, stimulation of retinal signals in a retinal prosthesis and detection of chemical potentials in an electrochemical sensor.

Low-aspect-ratio microelectrode arrays are fabricated using conventional silicon-based microfabrication techniques. These techniques utilize standard silicon processing methods such as photolithography, to yield arrays of thin films of metallic or carbon electrodes on a silicon substrate. Thin film, microfabricated microelectrode arrays often have limited stability and useful lifetime as a result of defects present in the various layers of the array. These defects lead to poor resistance to corrosion and subsequent swelling and delamination of the layers. Microfabricated arrays typically are fragile and cannot be cleaned using conventional cleaning methods and materials (polishing, solvents, sonication), but must be cleaned using methods such as reactive ion etching. Arrays of high aspect ratio, conducting microelectrodes have been of interest in neurobiology. These microelectrode arrays are designed to penetrate brain tissue to permit highly localized electrical stimulation and/or recording of signals from neural tissue. Silicon micromachining, silicon microfabrication and techniques involving bundling of multiple solid wires have been used to fabricate arrays of electrodes that are capable of penetrating neural tissue. There are advantages and disadvantages associated with each approach. Micromachined electrodes are limited in number (~10 to ~100) and are coated with a layer of platinum at the tip. These platinum coatings can crack due to mechanical stress or corrosion. Cracks can lead to contamination problems, delamination and the appearance of non-ohmic interfaces causing degradation in the performance of the electrodes. Although solid wire electrode arrays do not delaminate and will not exhibit non-ohmic interfaces, they typically have only a handful of electrodes. High-aspect-ratio microelectrode arrays are also of interest for their use as an electrical interface in an intraocular retinal prosthesis (IRP). An IRP is a device that is attached directly to the retina and that is intended to electrically stimulate the retina in an effort to restore vision to patients with impaired vision. An array of high-aspect-ratio microelectrodes is necessary to conduct the electrical stimulation from a flat microelectronic circuit to the curved surface of the retina.

Arrays of magnetic nanowires have been grown in nanochannel glass substrates using electrodeposition. The diameter of the magnetizable nanoposts ranged from 10-1000 nm. The arrays were made by electrodeposition of magnetizable material from plating solutions into the channels of a nanochannel glass template. These are nanocomposite materials that feature large numbers of densely packed, high-aspect-ratio, magnetic nanowires (up to $10^{12}/cm^2$ and claimed aspect ratios up to 10,000).

Nguyen and Tonucci in U.S. Pat. No. 6,185,961 taught a method for the manufacture of nanocomposite materials involving the electrodeposition of metal within the channels of nanochannel glass. The nanowire arrays taught by Nguyen are extremely small and are not well suited for electrode applications. This is due to the small size of the individual electrodes, the small overall size of the array and the limitation on the overall length of the nanowires. In addition, nanowire arrays can not be used as implantable electrodes because the wires are not long enough, nor are they strong enough to penetrate tissue. Further, the methods taught by Nguyen for the manufacture of nanowire arrays do not work for the deposition of wires having diameter greater than a micron. For example, the deposition art taught by Nguyen required occluding the ends of the nanochannels with a layer of sputtered metal. This approach cannot be used for microchannel samples because the channels are too big to occlude. The procedures taught in this disclosure for deposition in larger channels eliminate the need for occluding the channels.

Previous art for the electrodeposition of nanowire arrays (Nguyen) teaches deposition at constant voltage. Previous art (Nguyen) for the electrodeposition of nanowire arrays was limited to samples of extremely small surface area. This invention permits electrodeposition within microchannel glass templates without damage to the glass wafers. The methods taught in this disclosure also allow the deposition of metals with improved bio-compatibility and lower electrical impedance.

SUMMARY OF THE INVENTION

It is an object of this invention to provide an improved microelectrode array.

It is an object of this invention to provide solid metal electrodes which are superior to electrodes that are composed of several layers of materials. Layered microelectrodes are susceptible to mechanical and/or chemical damage that can cause layers to crack or peel. Cracking and peeling increases the resistance of the electrodes and can lead to complete failure. Solid metal electrodes are much more resistant to such chemical and/or mechanical damage.

Another object of this invention is to provide a microelectrode array in which the microelectrodes are metallic, have high aspect ratio, number up to in the millions, in high density patterns, and are electrochemically compatible with biological tissue.

Another object of this invention is to provide a microelectrode with high aspect ratio with typical lengths of 1 mm to 1.5 mm for tissue implants to minimize the injury to neural tissue and to minimize the volume of neural tissue affected.

Another object of this invention is to provide a microelectrode array in which the conducting, solid metal, high aspect ratio microelectrodes that comprise the arrays have diameters between 1 and 100 micrometers and aspect ratio of 200 to 500.

Another object of this invention is to provide electrode arrays having an extremely high electrode density ($>10^6/cm^2$). This provides the ability to communicate with a very large number of neurons in neural stimulation applications. It also provides a large redundancy if the electrode array is interfaced with a microelectronic circuit having micron-scale pixels. For example, ~80 or more 5.5 micrometer diameter microelectrodes having pitch of 8 micrometers may connect with a pixel if the pixel size is 30 microns by 30 microns.

A further object of this invention is to provide a microelectrode array in which the conducting, solid metal, high aspect ratio microelectrodes that comprise the arrays are a precious metal, for example, platinum, rhodium, iridium, gold, silver, nickel, copper, or palladium.

A further object of this invention is to show methods for the deposition of precious metal electrode arrays. The precious metals have high charge carrying capacities and are less likely than other metals to poison tissue.

A further object of this invention is to provide a microelectrode array in which the conducting, solid metal, high aspect ratio microelectrodes that comprise the arrays are bare wires of length up to 2 mm that are extremely stiff and hard.

A further object of this invention is to provide a microelectrode array in which the conducting, solid metal, high aspect ratio microelectrodes that comprise the arrays are deposited using electrochemical deposition throughout a template, under constant current conditions, and with careful limits on the maximum current at the start of the deposition, midway through the deposition and at the end of the deposition.

A further object of this invention is to teach a detailed protocol for controlling the deposition conditions that includes deposition at constant current and following careful restrictions on the maximum current at the start, midway and near the end of the deposition. The protocols are designed to maximize the quality of the electrode arrays by preventing sample "burning" due to the hydrolysis of water.

A further object of this invention is to provide channel glass with ~5 micrometer diameter channels that can have sample thickness in the range 1 to 2 mm. Millimeter-length channels cannot be obtained when the channel diameter is less than a micrometer. There are several important advantages of millimeter long channels. The longer channels allow the fabrication of wires that can protrude from the glass substrates after etch-back. These protruding wires can be implanted into tissue. Longer wires allow deeper probing. Longer wires also allow the substrate to be polished to a curved surface, which may be useful for forming an electrode array that needs to conform to a nonplanar surface. Longer wires also provide more exposed surface area. This lowers the electrical impedance for current flow into the surrounding media.

A further object of the invention is to teach a new method for producing arrays with bare wires that protrude from the surface. The length of the protruding wires can be selected by varying the amount of time that the array is exposed to an acid etchant. The increase in the surface area of the wires increases the total area that can interact with the neural tissue. This method allows the fabrication of implantable electrodes.

These and other objects of this invention are accomplished by preparing a porous microchannel glass template, mounting the template on a metal-coated glass slide, electrochemically depositing metal within the hollow channels of the glass template, and then grinding, polishing and, if desired, etching the microelectrode array.

BRIEF DESCRIPTION OF THE DRAWINGS

These and other objects, features and advantages of the invention, as well as the invention itself, will become better understood by reference to the following detailed description when considered in connection with the accompanying drawings wherein like reference numerals designate identical or corresponding parts throughout the several views and wherein.

DETAILED DESCRIPTION OF THE PREFERRED EMBODIMENT

Figure 1:
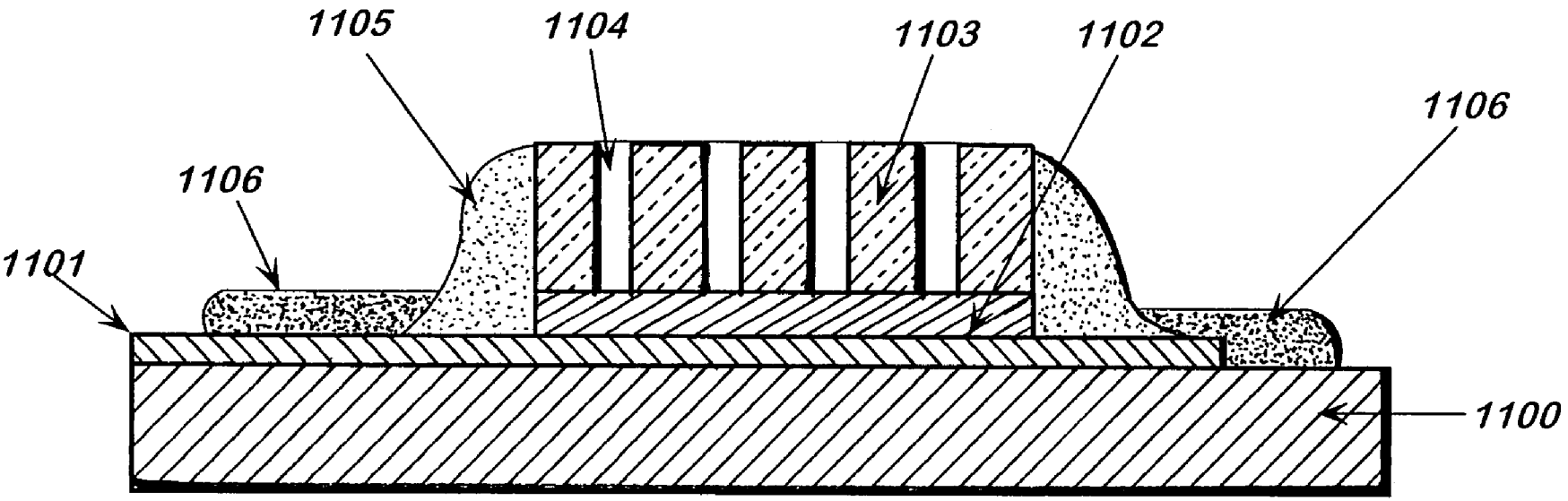
FIG. 1 is a schematic illustration of a porous, microchannel glass template in close contact with an electrode on a glass slide that will be used as the cathode during electrodeposition.

Electrode arrays are used for artificial retinal stimulation applications. This application requires the electrode array to serve as an interface between a flat microelectronic circuit board and the curved retina. In order to accomplish this, one side of the electrode array must be flat and the opposite side must be curved. In order to satisfy this requirement the electrode must be thick enough to permit a curved surface to be ground and polished. This requires arrays that are ~1 to ~2 mm thick assuming a 1 cm radius of curvature. For microelectrodes of diameter 5 microns or less, the required aspect ratio is greater than 200. Only the electrodes taught in this disclosure have the diameter and large aspect ratio needed to satisfy this requirement.

Conducting microelectrode arrays having high-aspect-ratio microwires were fabricated using electrodeposition methods similar to those used in the fabrication of nanowire arrays. The fabrication of microwires having both larger diameter and higher aspect ratio presented new challenges both in the preparation and use of the porous microchannel glass templates and in the electrodeposition procedures. Each task in the fabrication of a high-aspect-ratio microelectrode array is described in detail below. The tasks, broadly, are: 1) preparation of porous, microchannel glass templates; 2) electrodeposition of metal within the hollow channels of the glass template; and 3) final preparation of the array following electrodeposition.

The fabrication of rhodium electrode arrays provides several advantages. Rhodium has several properties that make it a superior choice for electrode use. It readily deposits with high current efficiency (~90%). By contrast platinum does not deposit readily and has a much lower efficiency (~10-20% typically). Higher efficiency allows quicker depositions to form the wires, maximizing yield. Rhodium has a high rigidity compared to other commonly electrodeposited materials such as copper, nickel, cobalt or iron, and in comparison to other materials used as neural electrodes, such as gold, platinum or iridium. Its rigidity modulus is higher than all but iridium, which cannot be electrodeposited except as thin films of about 1 micrometer or less thickness. The high rigidity allows the fabrication of protruding wires that cannot be easily bent and that can be pushed into tissue. Rhodium wires can also be readily pushed into indium in a process known as indium bump bonding, a commonly used method to make an electrical connection between two arrays of electrical contacts. The electrical resistivity of rhodium is not quite as good as silver, gold or copper, but is superior to nickel, iridium and platinum. Its resistivity is more than adequate for low current, low voltage electrode applications. Its hardness is superior to all of the above metals except iridium, where it is about even. The coefficient of thermal expansion of rhodium is superior to all other metals cited except iridium, and it matches within 10% of that of the non-etchable matrix glass. This allows the metal/glass composite to be heated with less risk of fracture due to unequal expansions of the two components. Lastly, the chemical and electrochemical stability of rhodium are high like that of gold, iridium or platinum. This means that the rhodium will not dissolve or be electrolyzed by current flow. Electrodes that dissolve can release metal ions or atoms into the biological solution, poisoning the cell or robbing it of nutrients.

Rhodium electrodes are amenable to the growth of thin adherent films, or caps, of iridium oxide. Iridium oxide has been shown to be an excellent electrical interface to neural tissue. It allows reversible electron transfer between the oxide layer and the electrode, allowing a buildup of charge on the electrode and causing a neural stimulus without adverse electrochemical reactions occurring in the surrounding media.

Preparation of Porous, Microchannel Glass Templates

Refer now to FIG. 1, a schematic diagram of the microchannel glass template prepared for electrodeposition. The porous, microchannel glass templates (1103) were etched wafers of microchannel plate glass. Microchannel glass boules, ~25 cm in length and 3 cm diameter were purchased from Litton EOS [Garland, Tex.]. The glass had circular, hexagonally close packed, acid-etchable elements that were ~5.5 micrometers in diameter. The center to center pitch between the acid-etchable elements was ~8 micrometers. The boule was cut into wafers, ranging in thickness from 0.25 mm to 2.5 mm, using a diamond saw. Both surfaces of the wafer were ground and polished. The microstructured region of the polished wafer was ~27 mm from flat to flat, the surface area was about 5 $cm^2$ and the channel density was $>10^6/cm^2$. It is important to note that greater than 40% of the surface area of an etched, microchannel plate glass is void space (occupied by channels). Because of this, the etched wafers are highly stressed and often distort to a nonplanar shape to the point of fracture upon drying. Although it is generally not possible to reduce the stress in the etched wafers without breaking them, the stress can be significantly reduced by annealing the wafers before they are etched. The unetched wafers were heated to 500° C. at a rate of 5° C./min, held at 500° C. for 1 hour, and then cooled to ambient temperature at 2° C./min.

The thermally annealed, unetched, microchannel glass wafers were etched by tumbling in 1% (by volume) acetic acid solution. The etching solution, of volume ~100 ml, was changed after 2-3 hours and the etching continued overnight, for a total etch time of 16-24 hours. The etched wafers were then rinsed (tumbled again) once or twice with deionized water for half an hour each. Etching of thick wafers of microchannel glass (~1 mm thick and up) occasionally leads to fracture of the glass in a plane parallel to the top and bottom surface of the wafer, near the center of the wafer. Etching thick wafers of microchannel glass also can lead to non-cylindrically shaped channels. Although the matrix glass of microchannel glass is referred to as an acid-inert glass, this terminology is relative to the etching rate of the etchable glass. In fact, the matrix glass does etch in acid, but at a lower rate. When the channel glass is in the etching solution for long durations, the matrix glass surfaces inside the hollow channels will etch, forming hourglass-shaped channels. Thus, the upper limit of the aspect ratio of the channels in the glass, and by extension, of the microwires in the microelectrode array, is determined by the glass properties and the specific glass etching procedures, not by the metal deposition procedure. Microchannel glass templates having aspect ratios in the range of 100 to 500 were readily prepared and used. The hollow channels in the glass were uniformly circular, perpendicular to the surface, and were parallel to one another (no overlapping channels).

In order to electrodeposit metal throughout the channels of the microchannel glass, the templates (1103) were mounted on metal-coated glass substrates, typically metal-coated microscope slides (1100). The slides provided support for the microchannel glass templates while immersed in the electrodeposition solutions and the metal-coating (1101)on the slides provided the electrical connection needed to drive the electrodeposition. The templates and the glass substrates were carefully cleaned prior to each being coated with metal to ensure good adherence of the metal coating. Failure to properly clean the glass resulted in the loss of adhesion of the metal films, which resulted in loss of electrical contact between the channel glass template and the glass substrate during electrodeposition. The cleaning procedure consisted of washing the glass pieces by hand in detergent and water. Next, the pieces were sonicated for 15 minutes in detergent and water. The detergent was free of insoluble particulates that could clog the channels of the template. The pieces were then sonicated in three successive rinse baths of distilled water. Lastly the pieces were dried by holding them in the warm vapor above a beaker of boiling isopropanol.

The templates were coated on one side with 100 nm thick films of titanium and platinum (1102), sputtered sequentially in vacuum at an incident angle of 45° with respect to the plane of the wafer. The wafers were rotated about an axis normal to the wafer surface during the sputtering. This permitted the metal to deposit uniformly on the edges of the channels (1104) as well as a short distance into the channels. The metallic coatings (1102) adhered well to the glass and provided a surface from which the electrodeposited metal could grow. Ideally, the metal film (1102) should completely occlude the channel ends, providing a continuous conducting surface in the channel from which wire growth can be initiated. This provides the most advantageous situation for the growth of uniform wires by electrodeposition. Larger diameter channels (>1 micrometer) could not, however, be effectively occluded by sputtering layers of metal. It was found that metal films, tens of micrometers, thick could pinch off these larger-diameter channels, but these films did not adhere to the glass and electrodeposition of metal in the channels was not successful. Electrodeposition throughout the 5.5 micrometer diameter channels (1104) was performed by coating one surface of the template with the thin titanium and platinum films (1102). No attempt was made to occlude the channels.

The glass substrates (1100) that support the channel glass during electrodeposition were also coated with similar titanium and platinum films (1101). When the substrate was a microscope slide, a titanium/platinum strip, ~⅝"×~2¼", was deposited onto the slide at normal incidence.

After sputtering, the hollow, channel glass templates (1103) were mounted on the metal-coated, glass substrates (1100). The template was bonded using five minute epoxy (1105) applied around the periphery. A light downward force was applied to the center of the template during epoxying and curing to insure that the Ti/Pt coated template maintained good contact with the Ti/Pt strip on the substrate. Epoxy (1106) was applied to all of the remaining exposed metal on the slide that was to be immersed in the electroplating solution in order to provide electrical isolation.

Figure 2:
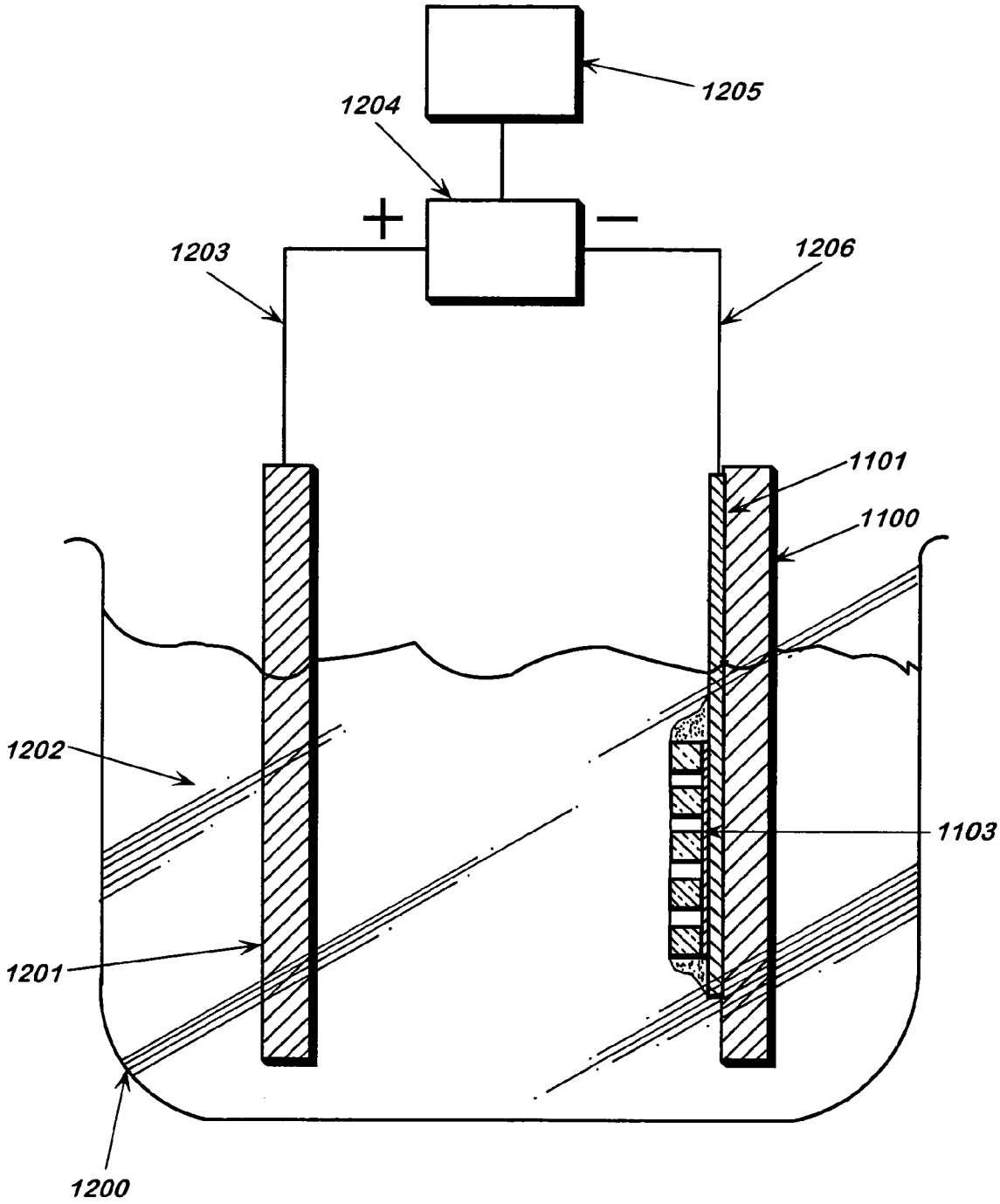
FIG. 2 is a schematic illustration of the electrochemical cell containing the microchannel template at the cathode, an anode, a constant current power supply monitored by a computer, and the electroplating solution.

Referring now to FIG. 2, the Ti/Pt strip (1101) on the substrate was connected by a wire (1206) to the deposition power supply (1204). The etched, circular channel glass templates were typically broken into four equal quarters. A portion of the Ti/Pt strip on the slide, which was subsequently kept above the electroplating solution, was not covered with epoxy in order to permit electrical contact with the external circuitry. While common "5 minute" epoxy is a convenient electrical insulator, its adhesion at elevated temperature (above 40° C.) is not optimal. Electrodeposition is often enhanced at elevated temperature and the solutions are frequently quite acidic or otherwise chemically harsh. A hard, inert epoxy (Epoxi-Patch 1C White, Dexter Corp.) is better suited to withstand harsh conditions and was used for deposition at elevated temperature.

Electrodeposition of Metal within the Hollow Channels of the Glass Template

Porous microchannel glass templates prepared following the procedures described above were used for the electrodeposition of microelectrode arrays using a wide range of metals. Several conducting metals, including platinum, palladium, gold, silver, copper, nickel, rhodium and iridium, were investigated and were deposited throughout the microchannel glass templates. The deposition of two of these metals rhodium and nickel, will be described.

Refer now to FIG. 2, a schematic of the electrochemical deposition apparatus. The electroplating solution (1202) is disposed within a container (1200), which can be a glass beaker. The counter electrode (anode) is typically a strip of the metal that is being deposited or platinum. The anode is connected by wire 1203 to the positive terminal of the deposition power supply (1204), that can operate in constant current mode. The microchannel glass template, prepared on the metal coated glass substrate as illustrated in FIG. 1, is connected by wire 1206 to the power supply (1204). The current and voltage as a function of time during the deposition are monitored by computer 1205. Electrodeposition of rhodium was performed using a commercially available electroplating solution, Techni Rhodium "S-less", available from Technic Inc., (Cranston R.I.). The solution is primarily $Rh_2(SO_4)_3$ in ~0.5M $H_2SO_4$. The solution was purchased in the 'heavy' formulation with a concentration equivalent to 10 grams of rhodium per liter of solution. The solution was used as received. The depositions were carried out at ~40° C., although room temperature was also adequate. The samples were mounted using the hard 'white' epoxy.

Electrodeposition was performed at constant current density. The maximum current density throughout most of the deposition was 5 milliamps per square centimeter of deposited material. The current density was controlled to ensure that hydrogen bubbling did not occur. Electrochemical generation of hydrogen bubbles is well known to result in pitted deposits, and can produce porous, non-uniform wires. The counter electrode (anode) was a strip of platinum foil with a surface area several times larger than the ~1.5 $cm^2$ channel glass template. The quality of the deposition was optimized by setting the initial current density during the first few hours of deposition to a low value of ~0.1 $mA/cm^2$. The voltage remained stable during deposition with only smooth gradual changes observed when the current density was changed. Rapidly fluctuating voltages, usually indicative of bubble formation due to the electrolysis of water, were avoided. Limiting the current density during the initial few hours, and limiting the maximum voltage thereafter to about 1.8 volts usually prevented such voltage fluctuations. After the first few hours, the deposition was carried out at a constant current density of 1-5 $mA/cm^2$. The high conductance of the deposition solutions, the use of a large area counter electrode, and the small separation between the electrodes (~3 cm) were sufficient to make the use of a reference electrode unnecessary. It should be noted that, even without bubble formation, higher current density can result in lower quality deposition. Although the voltage was allowed to freely range below 1.8 volts, it was typically observed to be quite steady in the 1.5-1.8 V range. Deposition rates were approximately 1 micrometer per $mA/cm^2$ per hour.

Final Preparation of the Array Following Electrodeposition

After deposition was completed, the rhodium microelectrode arrays were removed from the white epoxy seal by boiling in dimethylformamide for about 15 minutes. The array was then cleaned and polished on both sides. Samples that survived all the processing steps to this point were typically fairly robust. They could be heated to autoclaving temperatures without adverse effect on the structural integrity. Final sample preparation depended on the type of electrode array that was required. Arrays of microelectrode disks were fabricated by simply grinding and polishing flat the surfaces of the array. Alternatively, the array surface was first polished flat, and then the glass matrix was etched away from the surface with a solution of 5% hydrofluoric acid (HF) in water. This produced arrays of bare, high-aspect-ratio rhodium microwires. The etch rate was initially about 10 micrometers per minute but was observed to decrease as the etch depth increased. The HF solution appeared to have no effect on the metal. The physical characteristics of the rhodium microelectrode arrays prepared by electrodeposition throughout a microchannel glass template were investigated using a scanning electron microscope (SEM).

Figure 3:
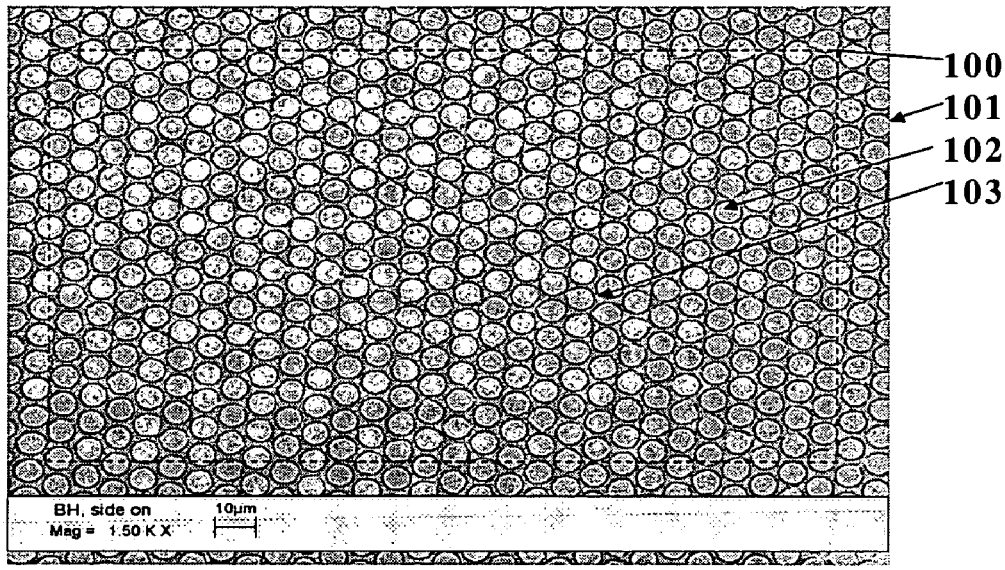
FIG. 3 is an SEM micrograph of the polished surface of a rhodium microelectrode array.

FIG. 3 is an SEM micrograph of the polished surface (100) of a rhodium microelectrode array (101) that illustrates the hexagonal close packed arrangement of the rhodium microwires (102) within the glass host (103). The diameter of each microwire is 5.5 micrometers. The view is normal to the surface of the array.

Figure 4:
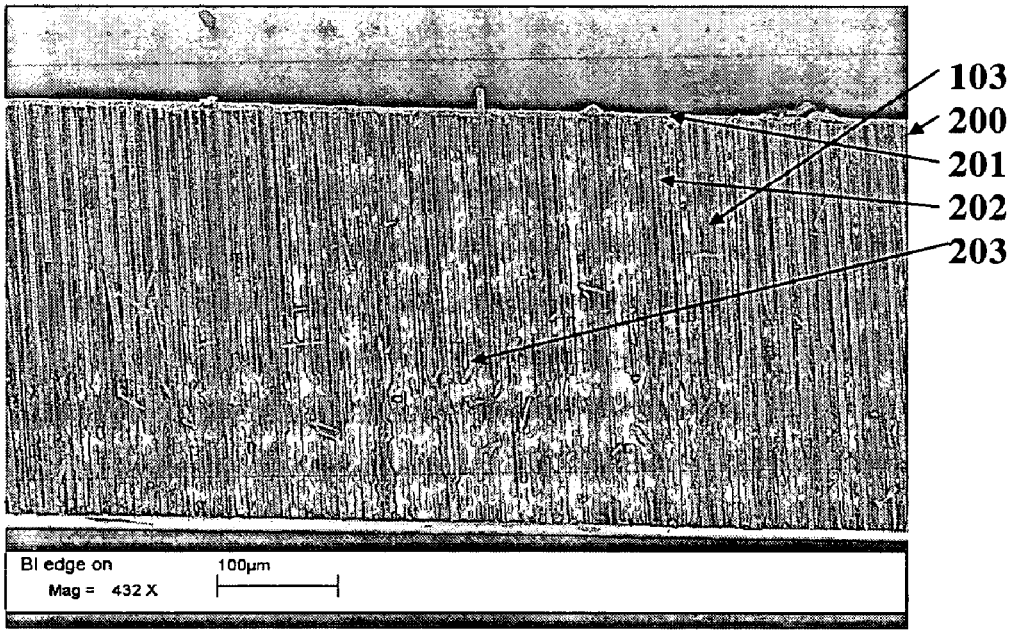
FIG. 4 is an SEM micrograph of a cleaved rhodium microelectrode array.

FIG. 4 is an SEM micrograph of a cleaved rhodium microelectrode array (200). The array (200) is ~375 micrometers thick. The cleaved surface (201) shows the rhodium microwires (202) embedded in the glass host (103). The view is normal to the cleaved surface (201). A number of broken rhodium microwires (203), released from the array as a result of the cleaving, are apparent on the cleaved surface (201).

Figure 5:
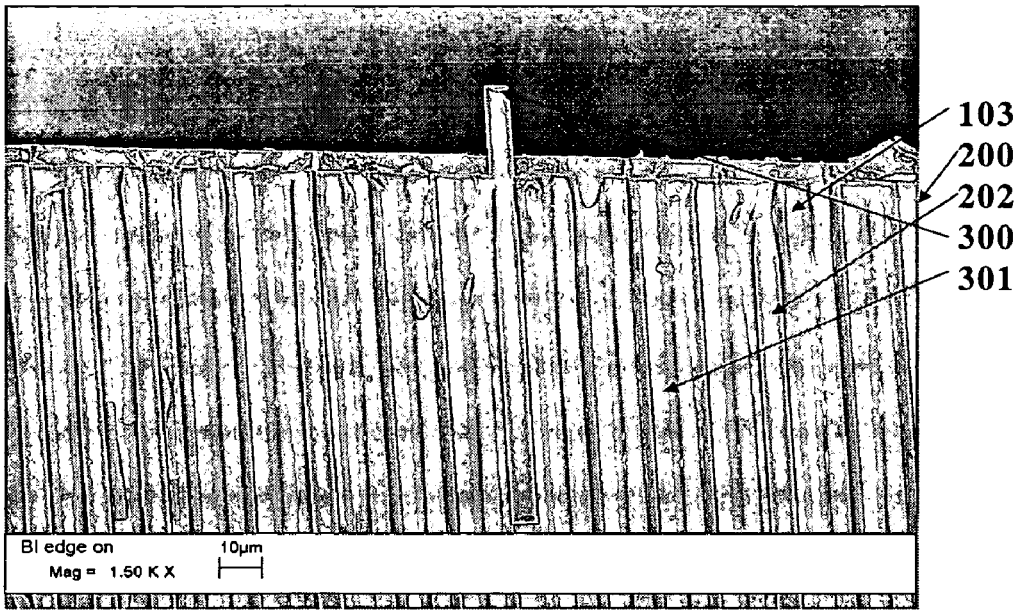
FIG. 5 is a higher magnification SEM micrograph of the rhodium microelectrode array shown in FIG. 4.

FIG. 5 is a higher magnification SEM micrograph of the rhodium microelectrode array (200) shown in FIG. 4, clearly showing the rhodium microwires (202) surrounded by the glass host (103). A single rhodium microwire fragment (300) is shown extending beyond the surface of the array. Several empty glass channels (301) are apparent. These empty channels (301) were created when rhodium microwires were released as a result of the damage caused by cleavage.

Figure 6:
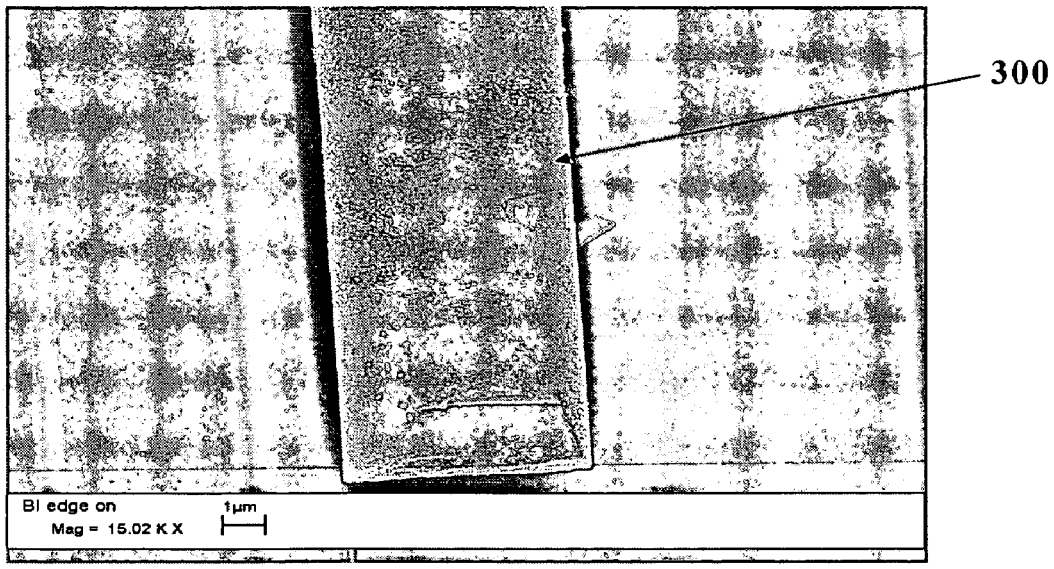
FIG. 6 is an extreme high magnification SEM micrograph of the single rhodium microwire fragment shown in FIG. 5.

FIG. 6 is an extreme high magnification SEM micrograph of the single rhodium microwire fragment (300) shown in FIG. 5.

Electrodeposition of other metals was similarly performed using commercially available electroplating solutions. Nickel was deposited using 'Techni Nickel S' (Technic Inc) nickel sulfamate solution. The solution was purchased in the RTU (ready to use) form, with no dilution with water necessary. When used as received, wire deposition was observed, but the bulk deposited nickel had a brownish cast, and although dense and hard, was somewhat coarse or grainy in appearance. Two additives; 'HN5' a surfactant, and 'semibright additive' were subsequently employed with this solution, significantly improving the appearance of the deposited nickel. Both additives were also purchased from Technic. The surfactant most likely ensured that the high aspect ratio, hollow channels were completely wetted by the solution.

High-aspect-ratio microelectrodes arrays of other conducting metals, including platinum, palladium, gold, silver, copper, and iridium, were also deposited throughout the microchannel glass templates. While the detailed electrodeposition procedures vary somewhat for each metal, the methods are generally similar. Table 1 summarizes the deposition conditions and results for the materials studied. The current density is the maximum value attained during the growth of the wires, and usually was sustained for the last 50-70% of the growth. The growth rate is averaged over the entire deposition. The efficiency given is very approximate, and is determined by dividing the observed length with that calculated assuming 100% efficiency and a metal density equal to the literature value. Since the density of the porous black platinum varies greatly with deposition conditions and is not tabulated, its efficiency was not calculated.

TABLE 1

Deposition conditions for metals studied

| Material | Voltage (V) | Current Density (mA/cm$^2$) | Temperature (K) | Growth Rate (μm/hr) | Current efficiency |
|---|---|---|---|---|---|
| Ag | 0.2 | 2 | 295 | ~4 | 0.5 |
| Au | 1.8 | 0.5 | 315 | ~1.7 | 0.9 |
| Cu | ~1 | 10 | 315 | ~12 | 0.9 |
| Ni | 1.7 | 5 | 295 | ~4 | 0.65 |
| Pt (black) | 2.3 | 3 | 315 | ~3 | — |
| Pt (silver) | 1.8 | 1-2 | 315 | ~0.5 | 0.3 |
| Rh | 1.5 | 4 | 315 | ~3 | 0.7 |

Figure 7:
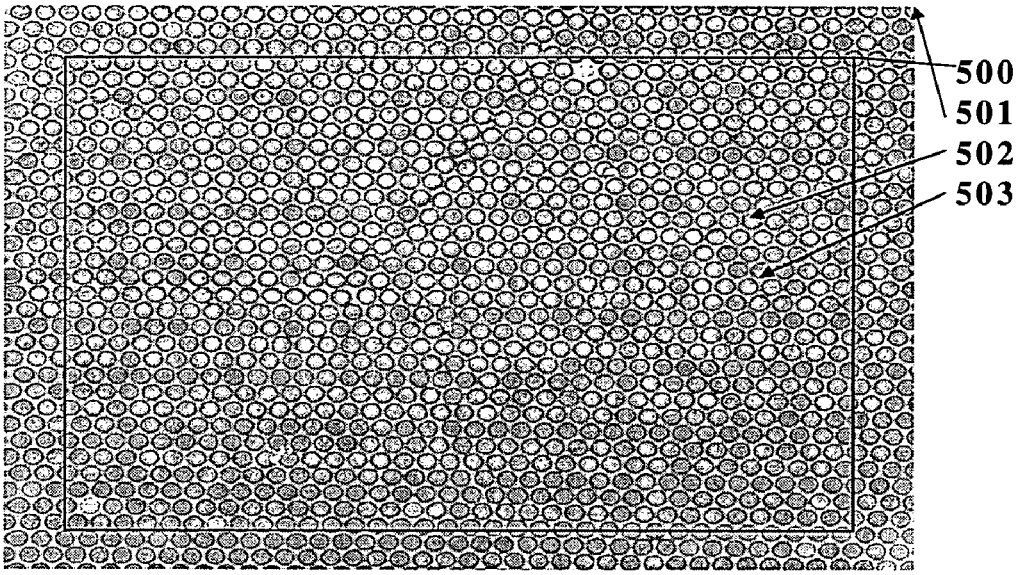
FIG. 7 is an SEM micrograph of the polished surface of a nickel microelectrode array.

The physical characteristics of the nickel microelectrode arrays were investigated using the SEM. FIG. 7 is an SEM micrograph of the polished surface (500) of a nickel microelectrode array (501) that illustrates the hexagonal close packed arrangement of the nickel microwires (502) within the glass host (503). The diameter of each microwire is 5.5 micrometers. The view is normal to the surface of the array.

Figure 8:
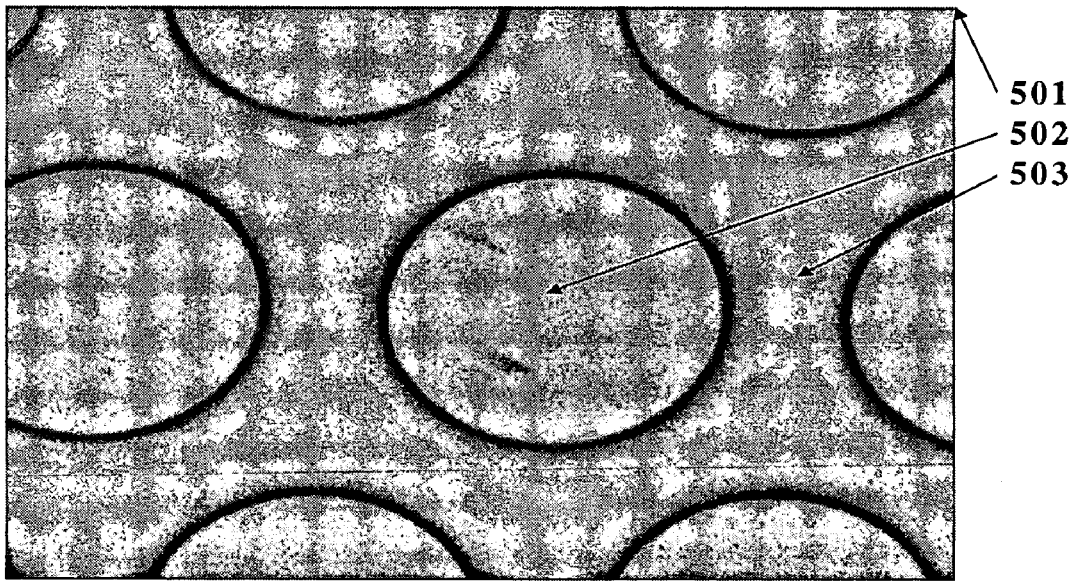
FIG. 8 is a higher magnification SEM micrograph of the same nickel microelectrode array shown in FIG. 7.

FIG. 8 is a higher magnification SEM micrograph of the same nickel microelectrode array (501) shown in FIG. 7, clearly showing the nickel microwires (502) surrounded by the glass host (503).

Figure 9:
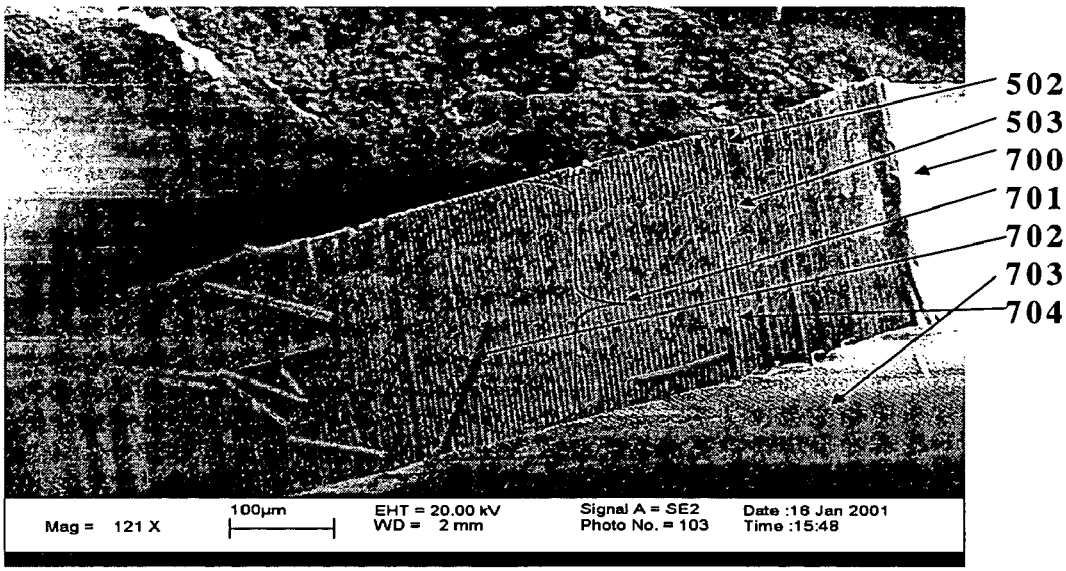
FIG. 9 is an SEM micrograph of a cleaved nickel microelectrode array, shown at an oblique angle.

FIG. 9 is an SEM micrograph of a cleaved nickel microelectrode array (700), shown at an oblique angle. The array (700) is ~300 micrometers thick. The cleaved surface (701) shows the nickel microwires (502) embedded in the glass host (503). A number of nickel microwires (702), released from the array as a result of the cleaving, are shown adhering to the cleaved surface (701) due to the magnetic attraction with the microwires still embedded in the glass (502). The polished surface (703) of the array is also shown. The cleaved surface (701) also clearly illustrates the effect of etching the cleaved array (700) in dilute HF. The glass host (503) is uniformly etched to a depth of ~70 micrometers, measured normal to the surface. The etching front (704), at a depth of ~70 micrometers is apparent on the cleaved surface (701). Behind the etching front (703), the nickel microwires (502) are surrounded by air, rather than glass. Beyond the etching front (704) the nickel microwires (502) are still surrounded by the glass host (503).

Figure 10:
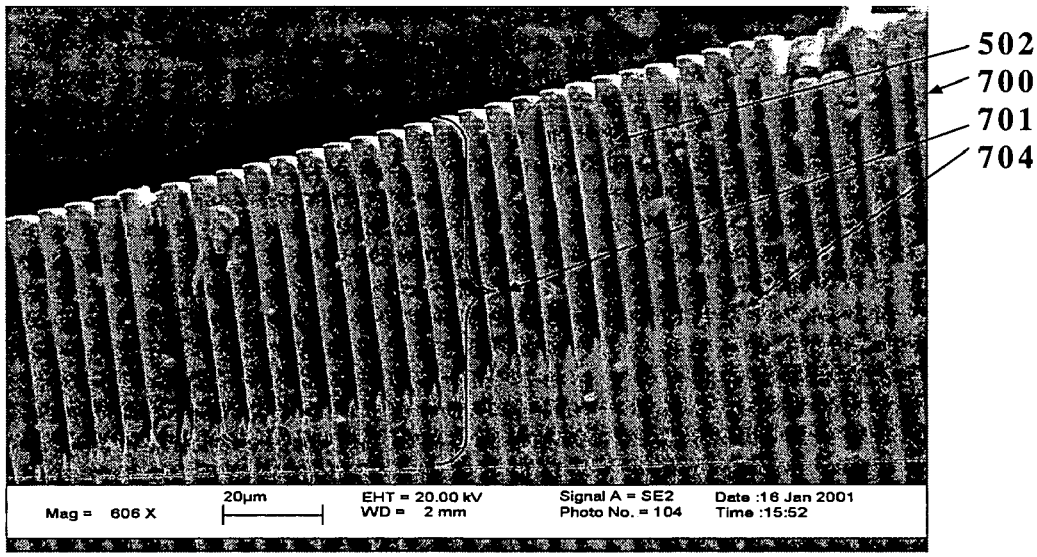
FIG. 10 is a higher magnification SEM micrograph of the same cleaved nickel microelectrode array shown in FIG. 9.

FIG. 10 is a higher magnification SEM micrograph of the same cleaved nickel microelectrode array (700) shown in FIG. 9. The cleaved surface (701), the microwires (502) and the etching front (704) are shown.

Figure 11:
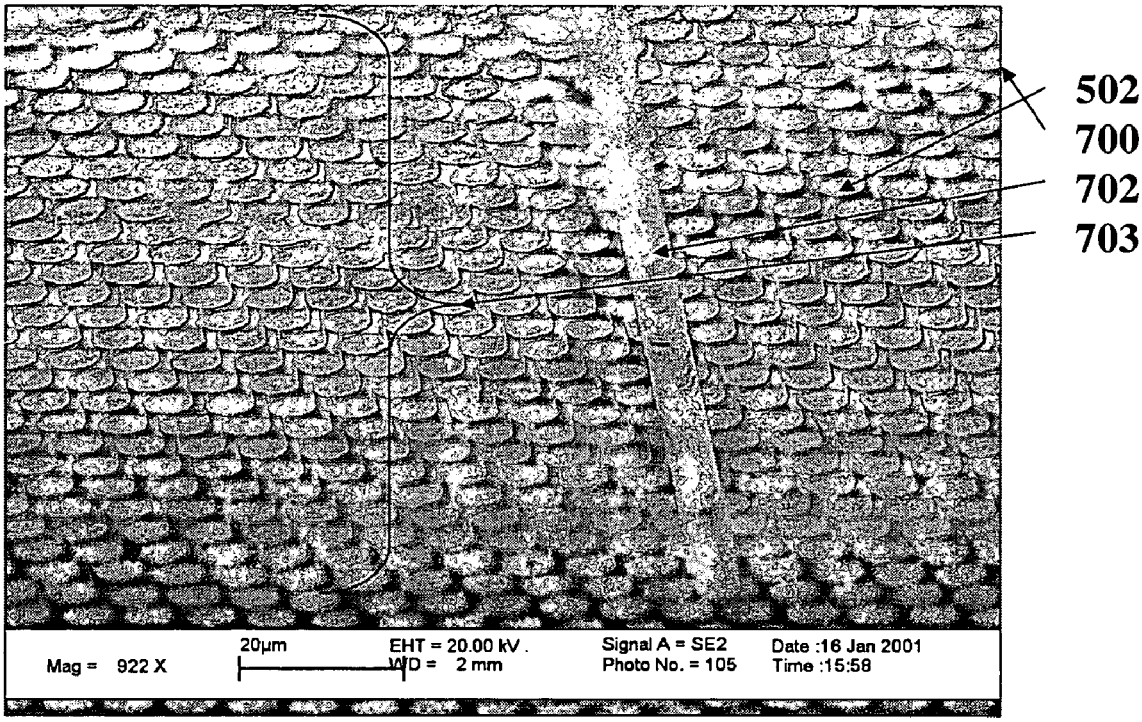
FIG. 11 is a higher magnification SEM micrograph of the same cleaved nickel microelectrode array shown in FIG. 9, illustrating the polished surface.

FIG. 11 is a higher magnification SEM micrograph of the same cleaved nickel microelectrode array (700) shown in FIG. 9, illustrating the polished surface (703). The nickel microwires (502) appear as bare wires because the glass host has been etched away. A free nickel microwire (702) is shown adhering to the polished surface (703).

Although this invention has been described in relation to an exemplary embodiment thereof, it will be understood by those skilled in the art that still other variations and modifications can be affected in the preferred embodiment without detracting from the scope and spirit of the invention as described in the claims:

What is claimed:

1. A method of electroplating a metal into a plurality of channels within an insulating material having a first face and a second face separated from the first face by a distance D, the plurality of channels extending from the first face to the second face, said method comprising:

mounting the material to a cathode;

placing the cathode into an electroplating solution containing the metal;

placing an anode into the electroplating solution;

connecting the cathode and the anode to a power supply;

controlling operation of the power supply to provide a beginning current density during deposition at the insulating material and initiating electroplating of the metal within the plurality of channels starting at the second face; and controlling operation of the power supply to provide a final current density during deposition at the insulating material and ending electroplating of the metal within the plurality of channels at the first face, wherein the final current density is larger than the beginning current density, and wherein the beginning current density is maintained at a level for a sufficient time to substantially prevent bubble formation during the electroplating.

2. The method of claim 1, wherein said controlling operation of the power supply to provide a final current density during deposition at the insulating material comprises controlling operation of the power supply such that the final current density is a maximum current density.

3. The method of claim 1, further comprising controlling operation of the power supply to provide a current density during deposition at the insulating material, that increases from the beginning current density to the final current density.

4. The method of claim 1, wherein the beginning current level is maintained at about 0.1 mA/cm$^2$ for about 2 hours and the final current density is maintained in a range of from about 1-5 mA/cm$^2$.

5. A method of electroplating a metal into a plurality of channels within an insulating material having a first face and a second face, the plurality of channels extending from the first face to the second face, said method comprising:

mounting the material to a cathode;

placing the cathode into an electroplating solution containing the metal;

placing an anode into the electroplating solution;

connecting the cathode and the anode to a power supply; and controlling operation of the power supply to provide a time-varying current density at the insulating material thereby electroplating the metal into the plurality of channels without generating hydrogen bubbles within the plurality of channels.

6. The method of claim 5, wherein said controlling operation of the power supply to provide a time-varying current density at the insulating material comprises controlling operation of the power supply such that beginning current density is a minimum current density and a final current density is a maximum current density.

7. The method of claim 5, further comprising controlling operation of the power supply to provide a current density, during deposition at the insulating material, that increases from a beginning current density to a final current density.

8. A method of fabricating a device, said method comprising:

mounting a template portion to a cathode, the template portion comprising an insulating material and having a first face and a second face, the template portion having a plurality of channels therein extending from the first face to the second face;

placing the cathode into an electroplating solution containing a metal;

placing an anode into the electroplating solution;

connecting the cathode and the anode to a power supply;

controlling operation of the power supply to provide a time-varying current density at the insulating material thereby electroplating the metal into the plurality of channels from the first face to the second face without generating hydrogen bubbles within the plurality of channels; and removing a portion of the template portion at the second face thereby exposing a portion of each of the plurality of metal portions.

9. The method of claim 8, further comprising grounding the template portion such that the second face has a positive radius of curvature with respect to the first face.

* * * * *